United States Patent [19]

Milan et al.

[11] Patent Number: 4,998,715

[45] Date of Patent: Mar. 12, 1991

[54] COPY SHEET HOLDDOWN SYSTEM

[75] Inventors: Otto G. Milan, Arlington Heights; Stanley Witczak, Chicago, both of Ill.

[73] Assignee: AM International, Inc., Chicago, Ill.

[21] Appl. No.: 274,270

[22] Filed: Nov. 18, 1988

[51] Int. Cl.[5] ..... B65H 5/22

[52] U.S. Cl. ..... 271/197; 271/276

[58] Field of Search ..... 271/194, 196, 197, 276

[56] References Cited

U.S. PATENT DOCUMENTS

| | | | |
|---|---|---|---|
| 2,294,407 | 9/1942 | Huffman | 271/197 |
| 3,942,788 | 3/1976 | Boyle | 271/276 X |
| 4,776,577 | 10/1988 | Marschke | 271/197 X |

*Primary Examiner*—Richard A. Schacher

*Attorney, Agent, or Firm*—Nicholas A. Camasto; John R. Hoffman

[57] ABSTRACT

A copy sheet feeding system for use in a printing, copying, duplicating and like machine includes a conveyor board for moving copy sheets thereover in seriatim fashion. A vacuum chamber extends lengthwise of the conveyor board, with openings extending longitudinally of the conveyor board and communicating with the vacuum chamber. An access mechanism is movable relative to the vacuum chamber and openings to effectivly expose the openings progressively in the direction of movement of the copy sheets. This effectively provides a moving vacuum device which moves with the copy sheets as the sheets move over the conveyor board.

8 Claims, 2 Drawing Sheets

FIG. 1
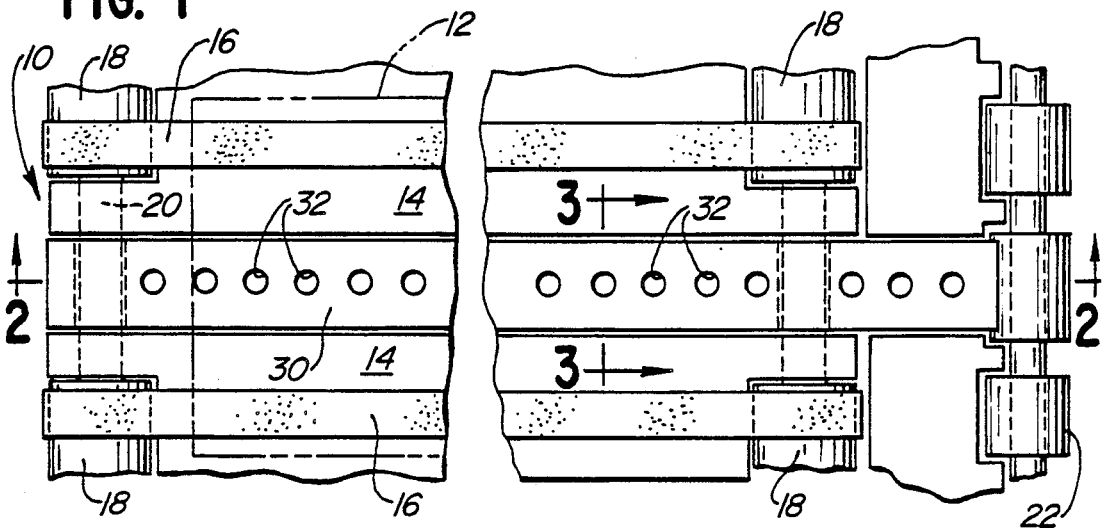
FIG. 2
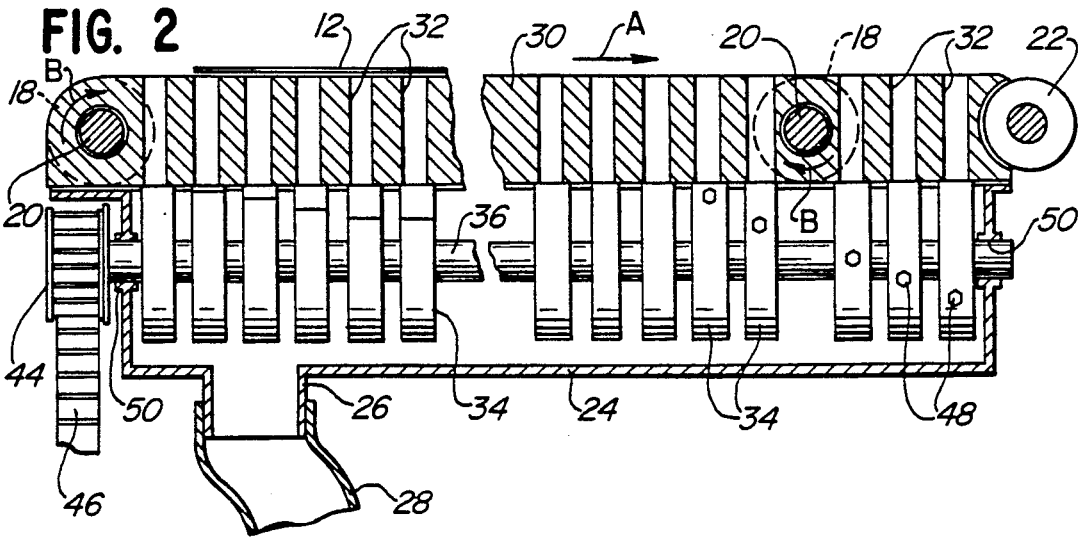
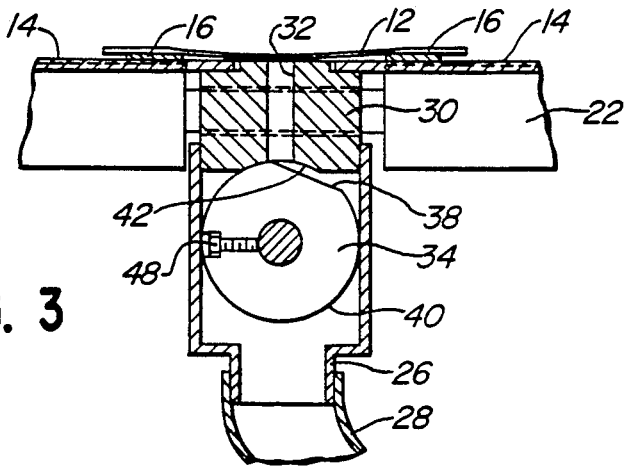
FIG. 3

FIG. 4
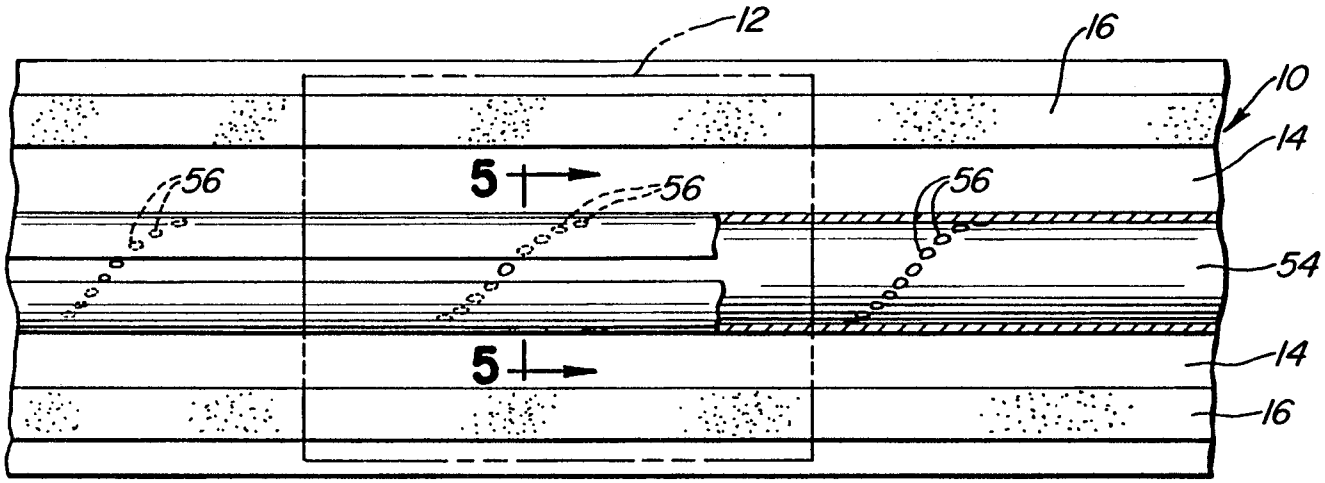
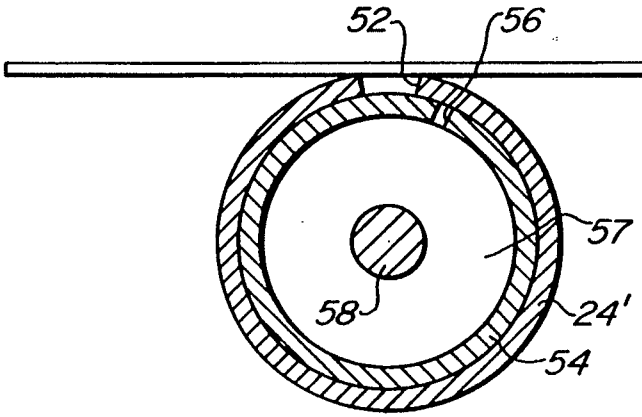
FIG. 5

COPY SHEET HOLDDOWN SYSTEM

FIELD OF THE INVENTION

This invention generally relates to a copy sheet feeding system in a printing, copying, duplicating and like machine and, particularly, to a copy sheet holddown system.

BACKGROUND OF THE INVENTION

In printing, copying, duplicating and like machines, copy sheets are fed through various stations of the machine individually and, often, at a high rate of speed. In some machines, the copy sheets are fed individually in a seriatim fashion (i.e. individually with spacing between the sheets) through the machine for copying purposes. For instance, the sheets may be fed individually from a stack of sheets at an in-feed station over a conveyor board to a registration station prior to feeding the sheets into the cylinders of the printing couple of the machine. Particularly in high speed machines, some type of "holddown" system is used to keep the sheets flat on the conveyor board. For instance, some machines operate at a rate of as much as 10,000 or more sheets per hour, and the sheets have a tendency of literally "flying" off of the conveyor board due to their light weight against air resistance. Consequently, some form of system usually is incorporated to hold the sheets down onto a subjacent support surface, such as a conveyor board.

Various holddown systems have used such mechanisms as cam surfaces for engaging the upper side edges of the copy sheets, sometimes with an overhead roller for engaging the sheets approximately on the centerline of their upper surfaces. Such mechanical systems may function satisfactorily in relatively slow machines, but mechanical systems often are insufficient in high speed machines. Air jet systems have been used in some high speed machines, but such systems often encounter problems in timing the air jets with the seriatim timing of the passing sheets. Some systems employ a combination of mechanical means and air jet means, but the drawbacks of either type of system still are present.

In still other machines, vacuum means have been employed as a copy sheet holddown medium. The problem with a vacuum system is its inherent nature of not being capable of rapid cycling, as with a pulsed air jet, and any leakage between sheets bleeds off the vacuum. Consequently, some machines feed the copy sheets in an interleaved array (i.e. whereby the leading and trailing edges of the sheets overlap). A continuous vacuum therefore can be employed because there is n spacing between the sheets which otherwise would bleed the vacuum means. This type of feeding system creates still further problems because it is not as easy to register interleaved copy sheets as it is to register individual copy sheets which are fed in a seriatim manner.

This invention is directed to solving the above problems and dilemmas by providing a new and improved copy sheet feeding system which employs vacuum means as the copy sheet holddown medium, the system being readily applicable for feeding sheets individually in seriatim fashion.

SUMMARY OF THE INVENTION

An object, therefore, of the invention is to provide a new and improved copy sheet feeding system for use in printing, copying, duplicating and like machines.

Generally, in the exemplary embodiment of the invention, the machine includes a conveyor board for moving the copy sheets thereover in seriatim fashion. Vacuum means extend lengthwise of the conveyor board. Vacuum accessing means are operatively associated with the vacuum means for communicating only a lengthwise portion of the vacuum means with an area of the conveyor board to hold a copy sheet on the conveyor board means when in that area. Means are provided for moving the vacuum accessing means relative to the vacuum means lengthwise of the conveyor board for movement with the copy sheet to hold the copy sheet on the conveyor board along a substantial length thereof.

As disclosed herein, the conveyor board means include at least a pair of generally parallel, movable belts for engaging the copy sheets, and the vacuum means extend lengthwise between the belts. The vacuum means include a vacuum chamber having opening means extending lengthwise of the conveyor board. The vacuum accessing means include means for exposing only a portion of the opening means.

In one embodiment of the invention, the opening means are defined by a manifold having a plurality of openings in an array longitudinally of the conveyor board. The vacuum accessing means exposes only some of the openings progressively in the direction of movement of the copy sheets. This is accomplished by a plurality of rotatable discs in alignment with the openings. The periphery of each disc closes a respective opening, and each disc has a peripheral recessed area for exposing its respective opening at a given angular orientation of the disc. The discs can be adjusted angularly about their axes of rotation to effectively adjust the timing of the vacuum accessing means.

In another embodiment of the invention, the opening means to the vacuum chamber is provided by a slot extending longitudinally of the conveyor board and, generally, the vacuum accessing means exposes only a portion of the slot progressively in the direction of movement of the copy sheets. This is accomplished by a rotatable tube having a spiral array of individual apertures which progressively are registered with the longitudinal slot and, thereby, provide a vacuum holddown system which moves with the copy sheets along the conveyor board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a fragmented top plan view of a conveyor board in a printing, copying, duplicating or like machine, and embodying one form of the vacuum holddown system of the invention;

FIG. 2 is a vertical section taken generally along line 2—2 in FIG. 1;

FIG. 3 is a fragmented vertical section taken generally along line 3—3 in FIG. 1;

FIG. 4 is a fragmented top plan view of a portion of a conveyor board, with an alternate form of the invention; and FIG. 5 is a vertical section taken generally along line 5—5 of FIG. 4.

DETAILED DESCRIPTION OF THE PREFERRED EMBODIMENT

Referring to the drawings in greater detail, and first to FIGS. 1–3, these Figures show one embodiment of the vacuum holddown system of the invention. A conveyor board, generally designated 10, is provided for supporting copy sheets 12 as the sheets are fed over the top of the conveyor board in seriatim fashion, (i.e. individual sheets with spacing therebetween). This is accomplished by conventional suction-cup in-feed systems. The conveyor board is generally conventional and includes platform means 14 along with a pair of spaced, parallel endless belts or tapes 16 which effectively move the copy sheets over the conveyor board in the direction of arrow "A". Such conveyor boards are used in printing, copying, duplicating and like machines between various stations of the machines. For instance, such conveyor board constructions are used between an infeed station of a machine, whereat a stack of copy sheets may be positioned, and a registration station where the copy sheets are individually registered prior to feeding the copy sheets into the printing couple of the machine. As viewed in FIGS. 1 and 2, the in-feed station might be located immediately to the left of the conveyor board and the registration station and/or printing couple might be located immediately to the right of the conveyor board.

To this end, endless belts 16 are wrapped around a pair of drive rollers 18 fixed to drive shafts 20, with one or both of the rollers being driven in the direction of arrows "B", to move the belts and effectively feed the sheets in the direction of arrow "A". The sheets then are fed between a pair of feed rollers, only a lower feed roller 22 being shown in the drawings, which feed the sheets seriatim to the registration station and the printing couple of the machine. Appropriate motor means (not shown) rotate drive shaft(s) 20 and feed rollers 22 according to the cyclic operation of the machine, as is known.

Generally, the invention contemplates the provision of vacuum means extending lengthwise of conveyor board 10, with vacuum accessing means operatively associated with the vacuum means for communicating only a lengthwise portion of the vacuum means with an area of the conveyor board to hold a copy sheet 12 on the conveyor board when in that area. Means are provided for effectively moving the vacuum accessing means relative to the vacuum means lengthwise of conveyor board 10 (i.e. in the direction of arrow "A") for movement with a copy sheet 12 to hold the copy sheet on the conveyor board along a substantial length thereof.

More particularly, in the embodiment of FIGS. 1–3, the vacuum means include a vacuum chamber 24 having a nipple 26 for receiving a conduit 28 which is in communication with a source of vacuum, such as a vacuum pump (not shown).

The vacuum accessing means which is operatively associated with vacuum chamber 24 is in the form of a manifold 30 having a plurality of openings 32 communicating the interior of vacuum chamber 24 effectively with the top surface of the conveyor board. In other words, FIGS. 2 and 3 show openings 32 extending vertically completely through manifold 30 between the interior of vacuum chamber 24, and FIG. 1 shows the top of the openings exposed in a linear array lengthwise of conveyor board 10. Preferably, the linear array of openings extend equidistant between and generally parallel to conveyor belts 14 as seen in FIG. 1.

The means for effectively moving the vacuum accessing means relative to continuous vacuum chamber 24 is provided in the form of a plurality of control discs 34 (see FIGS. 2 and 3) mounted along a shaft 36. It can be seen in FIG. 2 that each disc 34 is in alignment with a respective one of vacuum accessing openings 32 in manifold 30. As best seen in FIG. 3, each disc 34 has a recessed area 38 in a circular periphery 40 of the disc. The discs are positioned such that their peripheries 40 effectively close or block their respective openings 32 and their recessed areas 38 effectively open or unblock their respective openings. Again as seen in FIG. 3, manifold 30 may be provided with a concave recessed area 42 at each opening 32 for mating with the circular periphery of disc 34 to thereby facilitate sealing the opening when the periphery of the disc blocks the opening.

A pulley 44 (FIG. 2) is fixed to one end of shaft 36 for control discs 34. A drive belt 46 is wrapped around pulley 44 and about a drive shaft (not shown) of an appropriate motor means of the machine. Therefore, as shaft 36 is rotated, all of the control discs 34 rotate in unison with the shaft. In order to provide means for effectively moving the vacuum accessing means with a moving copy sheet, control discs 34 simply are fixed to shaft 36 in progressively differing, relative angular positions which, in turn, positions the recessed areas 38 in the disc peripheries at progressively differing angular dispositions. Therefore, it can be understood that, as the assembly of discs are rotated with shaft 36, vacuum is applied in an area of the conveyor board which literally moves with the copy sheets as the recessed peripheries of control discs 34 progressively open and then close access openings 32 communicating between the conveyor board and vacuum chamber 24.

Control discs 34 on shaft 36 provide ready means for adjusting the timing of the vacuum accessing means. In other words, it can be understood that by adjusting the relative angular orientation of the discs on shaft 36, the timing of the vacuum holddown means can be changed. This can be accomplished by various means, such as set screws 48 which can be loosened to adjust the angular orientation of each disc on shaft 36. Therefore, the motor which drives belt 46 need not have some form of complicated timing mechanism for timing the vacuum holddown means with the sheet in-feed means or the sheet registration means.

Of course, appropriate seal means (not shown) are employed throughout the system where applicable between relatively movable components, for efficiency purposes. For instance, seals would be provided between rotatable shaft 36 and the surrounding portions of vacuum chamber 24, as at 50 (FIG. 2), and additional seal means may be provided about the lower ends of openings 32 within concave recessed areas 42 (FIG. 3) for engaging the control disc peripheries.

FIGS. 4–5 show an alternate embodiment of the invention wherein, again, a vacuum chamber has opening means extending lengthwise of the conveyor board. However, in this embodiment, the vacuum chamber is in the form of a tubular construction 24' and the vacuum accessing means is in the form of an opening or slot 52 extending longitudinally of the conveyor board. In other words, slot 52 provides a continuous opening lengthwise of the conveyor board, versus the discrete or individual openings 32 of the embodiment of FIGS. 1–3.

Again, means are provided in the embodiment of FIGS. 4–5 for providing vacuum accessing means which expose only a portion of slot 52 progressively in the direction of movement of copy sheets 12, i.e. in the direction of arrow "A". This means takes the form of a tube 54 telescoped within vacuum tube 24' and having apertures 56 for accessing the source of vacuum to the conveyor board through slot 52. Apertures 56 are disposed or arranged about tube 54 in a spiral array as shown in FIG. 4. Therefore, just as with recessed areas 38 of control discs 34 in the embodiment of FIGS. 1–3, it can be understood that as tube 54 rotates, only a particular series or "length" of apertures 56 will be in alignment with slot 52, and, with proper direction of rotation of tube 54, only a portion of slot 54 will be exposed to the source of vacuum progressively to "move" with the copy sheet and continuously hold the copy sheet down onto the conveyor board.

Again, appropriate seal means (not shown) should be employed between the relatively movable components of the system of FIGS. 4–5. In addition, a source of vacuum (not shown) is connected to vacuum tube 24', preferably through one of the end plates 57 therefore. Tube 54 can be rotated by an appropriate shaft 58 extending through the end plates and connected to appropriate motive means.

Of course, other schemes of providing a moving vacuum holddown system are contemplated by the invention. For instance, a third belt (not shown) may be used between conveyor drive belts 16, with spaced series of openings or spaced apertures therein to progressively expose a vacuum chamber and thereby access the vacuum means with only an area of the conveyor board, progressively in the direction of movement of the copy sheets.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a printing, copying, duplicating and like machine, a copy sheet feeding system, comprising:

conveyor board means including at least a pair of generally parallel, movable belts for engaging the copy sheets and for moving the copy sheets over the conveyor board in seriatim fashion, the belts being transversely spaced to define an open area therebetween;

a common vacuum chamber extending lengthwise of the conveyor board means;

a manifold having a plurality of openings in an array longitudinally of the conveyor board means communicating between the common vacuum chamber and the open area between the movable belts;

mechanical vacuum accessing means operatively associated with the manifold for opening and closing only some of the openings and communicating only a lengthwise portion of the common vacuum chamber with a portion of the open area of the conveyor board between the movable belts to hold a copy sheet on the conveyor board means when in that portion of the area; and singular drive means for effectively moving the mechanical vacuum accessing means relative to the vacuum chamber lengthwise of the conveyor board means for movement with the copy sheet to hold the copy sheet on the conveyor board means along a substantial length thereof.

2. The sheet feeding system of claim 1 wherein said vacuum accessing means comprise a plurality of rotatable discs in alignment with said openings, the periphery of each disc closing a respective opening, and each disc having a peripheral recessed area for exposing the respective opening at a given angular orientation of the disc.

3. The sheet feeding system of claim 2, including mans for adjusting the relative angular positions of the discs to adjust the timing of the vacuum accessing means.

4. In a printing, copying, duplicating and like machine, a copy sheet feeding system, comprising:

conveyor board means including at least a pair of generally parallel, movable belts for engaging the copy sheets and for moving the copy sheets over the conveyor board in seriatim fashion;

a vacuum chamber having a slot extending longitudinally of the conveyor board means between the movable belts;

vacuum accessing means operatively associated with the vacuum chamber including means for exposing only a portion of the slot to hold a copy sheet on the conveyor board when in alignment with said portion of the slot; and means for effectively moving the vacuum accessing means relative to the vacuum chamber lengthwise of the conveyor board means for movement with the copy sheet to hold the copy sheet on the conveyor board means along a substantial length thereof.

5. The sheet feeding system of claim 4 wherein said means for exposing comprise a rotatable tube having spiral aperture means for progressively registering with said longitudinal slot.

6. The sheet feeding system of claim 5 wherein said spiral aperture means comprise a spiral array of individual apertures.

7. In a printing, copying, duplicating and like machine, a copy sheet feeding system, comprising:

conveyor board means including at least a pair of generally parallel, movable belts for engaging the copy sheets and for moving the copy sheets over the conveyor board in seriatim fashion;

a vacuum means extending lengthwise of the conveyor board means, said vacuum means including a vacuum chamber extending lengthwise of the conveyor board means with opening means defined by a slot extending longitudinally of the conveyor board means between the movable belts;

vacuum accessing means operatively associated with the vacuum means for communicating only a lengthwise portion of the vacuum means with an area of the conveyor board means to hold a copy sheet on the conveyor board means when in that area, said vacuum accessing means including a rotatable tube having spiral aperture means for progressively registering with said longitudinal slot for exposing only a portion of the slot progressively in the direction of movement of the copy sheets; and means for effectively moving the vacuum accessing means relative to the vacuum chamber lengthwise of the conveyor board means for movement with the copy sheet to hold the copy sheet on the conveyor board means along a substantial length thereof.

8. The sheet feeding system of claim 7 wherein said spiral aperture means comprise a spiral array of individual apertures.

* * * * *